US009695669B2

(12) United States Patent
Burckhard

(10) Patent No.: US 9,695,669 B2
(45) Date of Patent: Jul. 4, 2017

(54) WELL PACKER WITH NONROTATING MANDREL LOCK DEVICE

(71) Applicant: HALLIBURTON ENERGY SERVICES, INC., Houston, TX (US)

(72) Inventor: Shane R. Burckhard, Sanger, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 371 days.

(21) Appl. No.: 14/373,606

(22) PCT Filed: Aug. 2, 2013

(86) PCT No.: PCT/US2013/053449

§ 371 (c)(1),
(2) Date: Jul. 21, 2014

(87) PCT Pub. No.: WO2015/016945

PCT Pub. Date: Feb. 5, 2015

(65) Prior Publication Data

US 2015/0034300 A1 Feb. 5, 2015

(51) Int. Cl.

| | |
|---|---|
| ***E21B 33/12*** | (2006.01) |
| ***E21B 33/129*** | (2006.01) |
| ***E21B 23/06*** | (2006.01) |

(52) U.S. Cl.

CPC ..... *E21B 33/1293* (2013.01); *E21B 23/06* (2013.01)

(58) Field of Classification Search

CPC .... E21B 23/06; E21B 33/1295; E21B 33/128; E21B 33/1293; E21B 23/00; E21B 33/129

See application file for complete search history.

(56) References Cited

U.S. PATENT DOCUMENTS 4,156,460 A * 5/1979 Crowe ..... E21B 23/06 166/120
4,176,715 A * 12/1979 Bigelow ..... E21B 33/1291 166/138
4,224,987 A * 9/1980 Allen ..... E21B 33/1295 166/120

(Continued)

OTHER PUBLICATIONS

International Search Report with Written Opinion issued Apr. 28, 2014 for PCT Patent Application No. PCT/US13/053445, 11 pages.

(Continued)

*Primary Examiner* — Daniel P Stephenson

(74) *Attorney, Agent, or Firm* — Locke Lord LLP

(57) ABSTRACT

A method of constructing a packer assembly can include installing a body lock ring on a mandrel, and then outwardly surrounding the body lock ring with a structure displaceable relative to the mandrel by a setting mechanism. A packer assembly can include a setting mechanism which displaces a structure relative to a mandrel, and a mandrel lock device which permits one way displacement of the structure relative to the mandrel, the mandrel lock device including a body lock ring and a bias sleeve which urges the body lock ring into gripping engagement with the mandrel, the bias sleeve and the structure being separate elements of the packer assembly. The bias sleeve can be secured against rotation relative to the mandrel while the structure is rotatable relative to the mandrel.

21 Claims, 7 Drawing Sheets

(56) References Cited

U.S. PATENT DOCUMENTS

| | | | | |
|---|---|---|---|---|
| 4,393,929 | A * | 7/1983 | Akkerman | E21B 33/1295 166/120 |
| 4,693,317 | A | 9/1987 | Edwards et al. | |
| 5,129,454 | A | 7/1992 | Telfer | |
| 5,343,963 | A * | 9/1994 | Bouldin | E21B 23/00 166/65.1 |
| 7,080,693 | B2 * | 7/2006 | Walker | E21B 33/1295 166/187 |
| 8,579,023 | B1 * | 11/2013 | Nish | E21B 33/128 166/118 |
| 2002/0056553 | A1 | 5/2002 | Duhon et al. | |
| 2008/0236844 | A1 * | 10/2008 | Gaudette | E21B 23/06 166/387 |
| 2009/0023502 | A1 | 1/2009 | Koger | |
| 2009/0151960 | A1 * | 6/2009 | Rogers | E21B 23/06 166/386 |
| 2009/0242188 | A1 | 10/2009 | Hadley | |
| 2009/0294137 | A1 | 12/2009 | Meijer | |
| 2009/0308592 | A1 | 12/2009 | Mercer et al. | |
| 2010/0038073 | A1 | 2/2010 | Carro | |
| 2014/0196913 | A1 * | 7/2014 | Pedersen | E21B 33/134 166/386 |
| 2015/0034300 | A1 * | 2/2015 | Burckhard | E21B 33/1293 166/138 |
| 2016/0123106 | A1 * | 5/2016 | Sechere | E21B 33/128 166/377 |
| 2016/0138363 | A1 * | 5/2016 | Sommers | E21B 23/06 166/387 |
| 2016/0168938 | A1 * | 6/2016 | Pray | E21B 23/06 166/377 |
| 2016/0168945 | A1 * | 6/2016 | Halbert | E21B 33/129 166/118 |

OTHER PUBLICATIONS

International Search Report with Written Opinion issued May 2, 2014 for PCT Patent Application No. PCT/US13/053449, 15 pages.

Ip.com; "Release Mechanism for Packer Set in Compression", An Ip.com Prior Art Database Technical Disclosure, Ip.com No. IPCOM000208819D, dated Jul. 19, 2011, 5 pages.

* cited by examiner

WELL PACKER WITH NONROTATING MANDREL LOCK DEVICE

CROSS-REFERENCE TO RELATED APPLICATION

This application is a national stage under 35 USC 371 of International Application No. PCT/US13/53449, filed on 2 Aug. 2013. The entire disclosure of this prior application is incorporated herein by this reference.

TECHNICAL FIELD

This disclosure relates generally to equipment utilized and operations performed in conjunction with a subterranean well and, in one example described below, more particularly provides a packer with a nonrotating mandrel lock device.

BACKGROUND

Well packers are used to seal off annular spaces in wells. For example, a packer can be used to seal off a space radially between inner and outer tubular strings, or between a wellbore and a casing or liner string.

Packers can include setting mechanisms for longitudinally compressing one or more seal elements, so that the seal elements extend radially outward into sealing contact with an exterior surface. Setting mechanisms may also, or alternatively, be used for outwardly extending gripping devices or "slips" for gripping the exterior surface.

Therefore, it will be appreciated that improvements are continually needed in the arts of constructing and utilizing packers for use in wells. Such improvements could be incorporated into well packers, whether or not the packers include setting mechanisms which longitudinally compress seal elements and/or outwardly extend slips of the packers.

DETAILED DESCRIPTION

Figure 1:
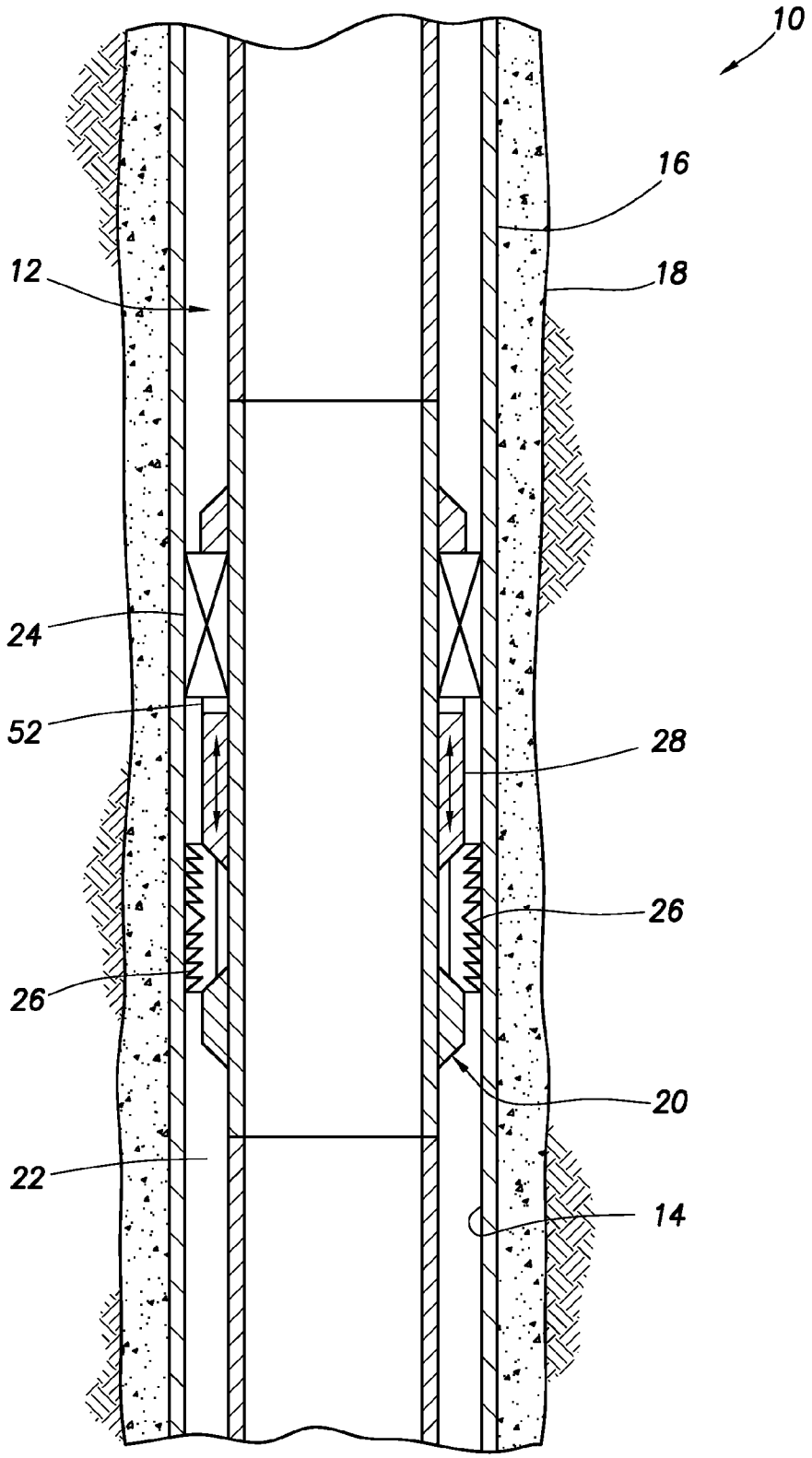
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 (such as, a production tubing string, a liner string, a casing string, a completion string, etc.) is installed in a wellbore 14. The wellbore 14 is depicted as being lined with casing 16 and cement 18, but in other examples the tubular string 12 could be positioned in an uncased or open hole portion of the wellbore.

The tubular string 12 includes a packer assembly 20. When activated or "set" in the wellbore 14, the packer assembly 20 seals off an annulus 22 formed radially between the tubular string 12 and the wellbore. The packer assembly 20, in this example, also grips the casing 16, so that the tubular string 12 is secured against displacement relative to the casing.

For sealing off the annulus 22, the packer assembly 20 includes one or more outwardly extendable annular seal elements 24. For gripping engagement with the casing 16 (or another tubular string, such as a liner or a tubing string, or a formation wall, etc.), the packer assembly 20 includes one or more slips or gripping devices 26.

A setting mechanism 28 is used to outwardly extend the seal elements 24 and gripping devices 26. In this example, the setting mechanism 28 is pressure actuated, and is positioned between the seal elements 24 and gripping devices 26, but other types of setting mechanisms and other positions of setting mechanisms may be used, in keeping with the scope of this disclosure.

Figure 2:
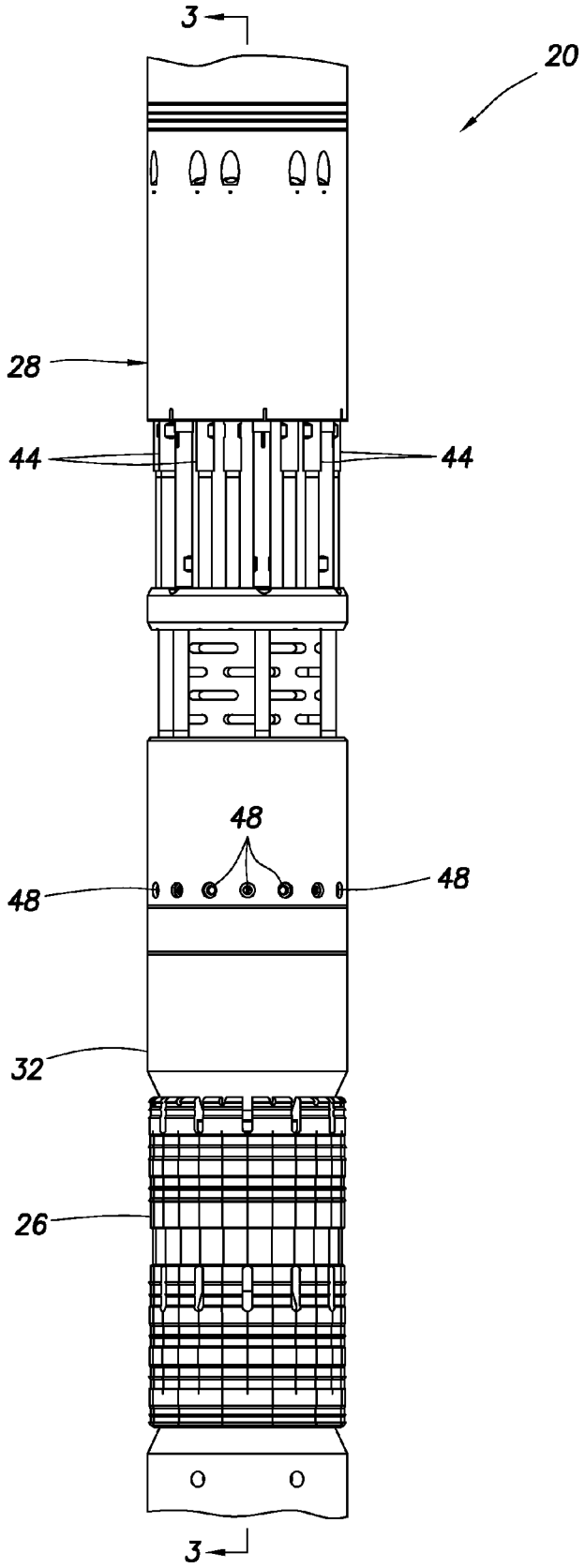
FIG. 2 is a representative side view of an example packer assembly which can embody principles of this disclosure, the packer assembly being depicted in a run-in unset configuration.
Figure 3:
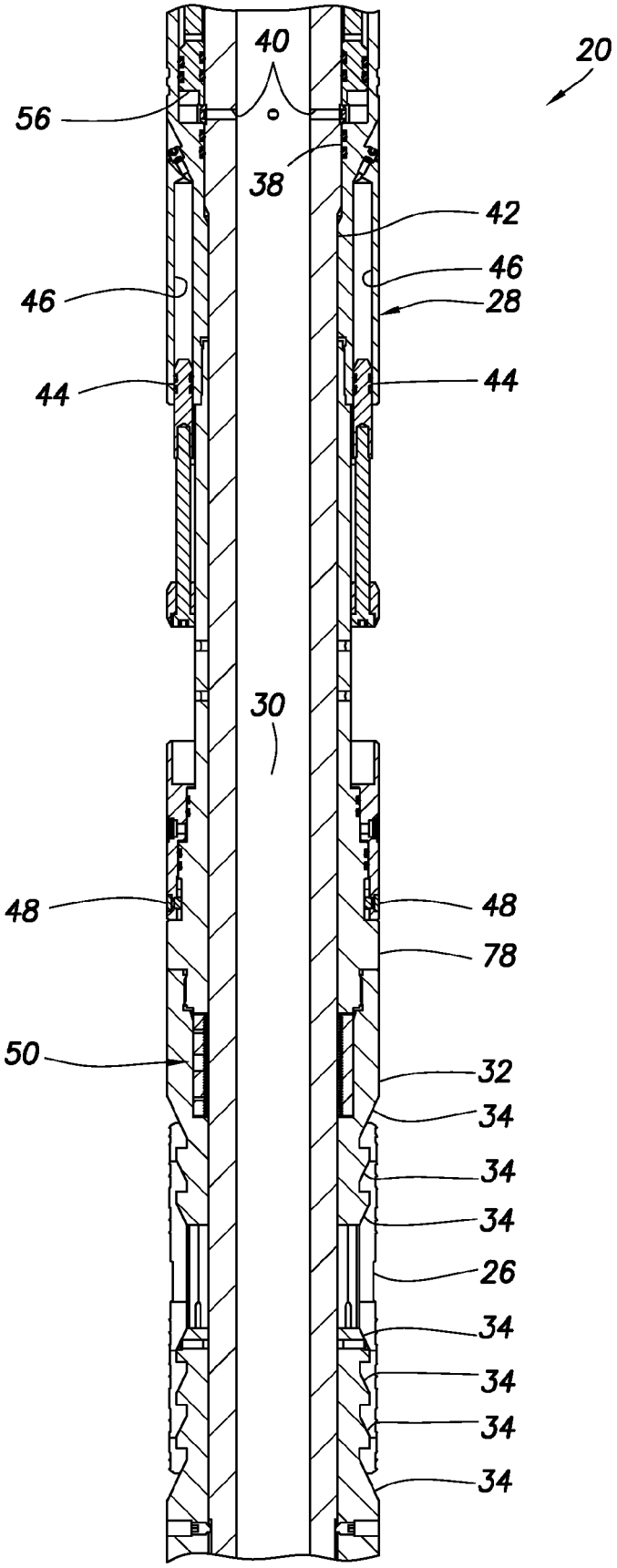
FIG. 3 is a representative cross-sectional view of the packer assembly, taken along line 3-3 of FIG. 2.

Referring additionally now to FIGS. 2 & 3, an example of the packer assembly 20 is representatively illustrated in side and cross-sectional views, respectively, apart from the remainder of the system 10. Note that the packer assembly 20 can be used in other systems and methods, in keeping with the principles of this disclosure.

Only a longitudinal section of the packer assembly 20 is depicted in FIGS. 2 & 3, for clarity of illustration of the setting mechanism 28 and its operation. The setting mechanism 28 and the remainder of the longitudinal section of the packer assembly 20 are illustrated in FIGS. 2 & 3 prior to setting of the packer assembly.

In the unset configuration depicted in FIGS. 2 & 3, the gripping device 26 and seal element(s) 24 (not visible in FIGS. 2 & 3) have not yet been extended outward into gripping and sealing contact, respectively, with the wellbore 14. When the setting mechanism 28 is activated by application of increased pressure to an internal flow passage 30, the setting mechanism will apply a downwardly directed setting force to an upper wedge device 32 underlying an upper end of the gripping device 26, and will apply an upwardly directed setting force to the seal element(s) 24, thereby outwardly extending the gripping device 26 and the seal element(s).

Figure 4:
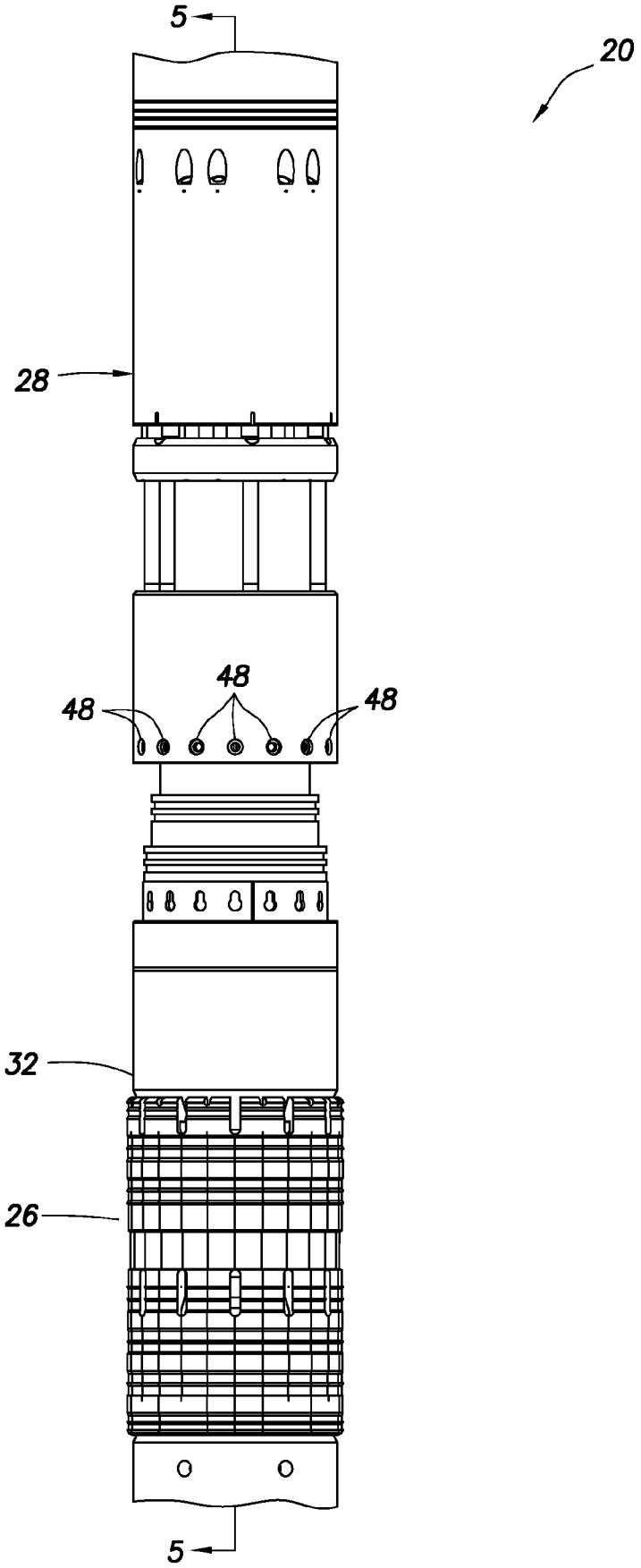
FIG. 4 is a representative side view of the packer assembly, the packer assembly being depicted in a set configuration.
Figure 5:
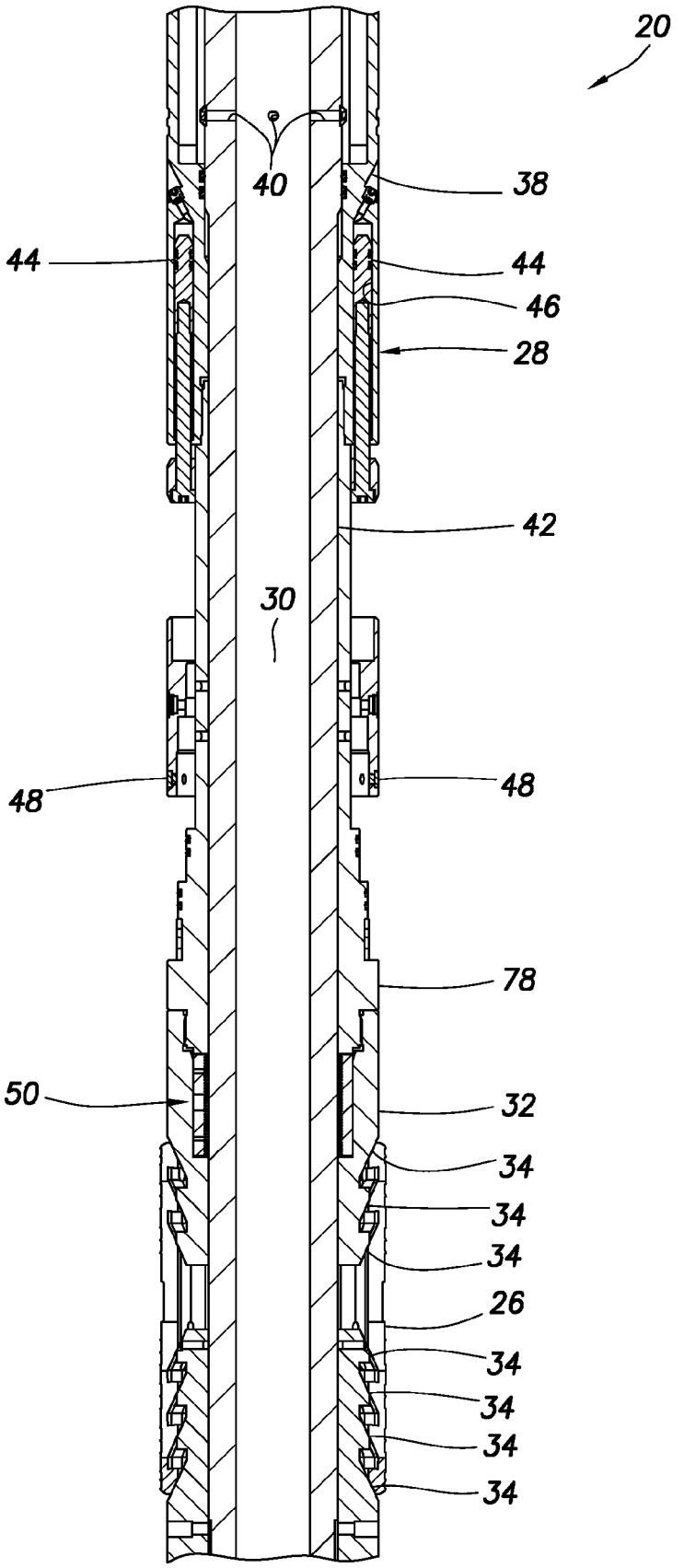
FIG. 5 is a representative cross-sectional view of the packer assembly, taken along line 5-5 of FIG. 4.

The downwardly directed setting force will displace the upper wedge device 32 downward, thereby causing the gripping device 26 to be urged outward by inclined surfaces 34 formed on the upper wedge device and on a lower wedge device 36 underlying a lower end of the gripping device 26. In this manner, the gripping device 26 is displaced radially outward when the packer assembly 20 is set, as depicted in FIGS. 4 & 5.

The downwardly directed setting force is produced due to a pressure differential created across an annular piston 38. One side of the piston 38 is exposed to pressure in the passage 30 via openings 40 extending through a wall of a tubular mandrel 42 of the packer assembly 20. An opposite side of the piston 38 is exposed to pressure on an exterior of the packer assembly 20 (for example, in the annulus 22 in the system 10 of FIG. 1).

The downwardly directed setting force is further produced due to pressure differentials created across a circumferentially spaced apart series of longitudinally extending rod pistons 44 received in bores 46 formed in the piston 38. Each of the rod pistons 44 is exposed on one side to a reduced pressured in the corresponding bore 46 (for example, approximately atmospheric pressure or another relatively low pressure), and on an opposite side to the pressure on the exterior of the packer assembly 20.

The pressure differential across each of the rod pistons 44 increases, in this example, due to increased hydrostatic pressure as the packer assembly 20 is lowered into the wellbore 14. The rod pistons 44 are secured against upward displacement relative to the upper wedge device 32, and so the pressure differential across the rod pistons acts to downwardly bias the annular piston 38.

When it is desired to set the packer assembly 20, pressure in the passage 30 is increased (e.g., using pumps at the earth's surface, etc.), in order to increase the pressure differential across the annular piston 38. A series of shear screws 48 are sized and numbered appropriately, so that the shear screws will shear when a predetermined setting force is produced.

Another annular piston 56 (see FIG. 3) is provided in the setting mechanism 28 for outwardly extending the seal element(s) 24. Similar to the annular piston 38, the annular piston 56 can be exposed on one side to pressure in the passage 30, and on an opposite side to pressure on the exterior of the packer assembly 20.

Shear pins, shear screws or another type of releasable retainer can be used to prevent upward displacement of the piston 56 until a predetermined pressure differential is applied across the piston. In the FIGS. 2-5 example, upward displacement of the piston 56 causes outward extension of the seal element(s) 24, substantially due to longitudinal compression of the seal element(s).

The upward displacement of the piston 56 could also, or alternatively, cause outward extension of the seal element(s) 24 by pushing the seal element(s) onto a radially enlarged surface, by bowing the seal element(s) outward, etc. Thus, the scope of this disclosure is not limited to any particular manner of extending the seal element(s) 24 outward.

In FIGS. 4 & 5, the packer assembly 20 is representatively illustrated in its set configuration. The shear screws 48 have sheared in response to a predetermined pressure differential being created across the annular piston 38 (assisted by the pressure differential due to hydrostatic pressure exposed to the rod pistons 44). The gripping device 26 is outwardly extended due to downward displacement of the upper wedge device 32.

A mandrel lock device 50 prevents the wedge device 32 from displacing upward relative to the mandrel 42 after the wedge device has been downwardly displaced by the setting mechanism 28. Thus, the lock device 50 permits only one-way displacement of the wedge device 32 relative to the mandrel 42.

In this manner, the gripping device 26 will not be permitted to retract after it has been outwardly extended by downward displacement of the wedge device 32 by the setting mechanism 28. This maintains the gripping engagement between the gripping device 26 and the casing 16 (or other exterior surface engaged by the gripping device).

A similar mandrel lock device can be used to prevent the seal element 24 from sealingly disengaging from the casing 16 (or other exterior surface engaged by the seal element). For example, the annular piston 56 could upwardly displace a structure 52 (see FIG. 1) which longitudinally compresses the seal element 24 (or otherwise outwardly extends the seal element), and another mandrel lock device (e.g., similar to the lock device 50) could prevent downward displacement of the structure relative to the mandrel 42.

Thus, the upper wedge device 32 is merely one example of a structure for which one-way displacement relative to the mandrel 42 can be provided using a lock device, such as the mandrel lock device 50. The scope of this disclosure is not limited to use of the mandrel lock device 50 with any particular type of structure displaced by the setting mechanism 28.

Figure 6:
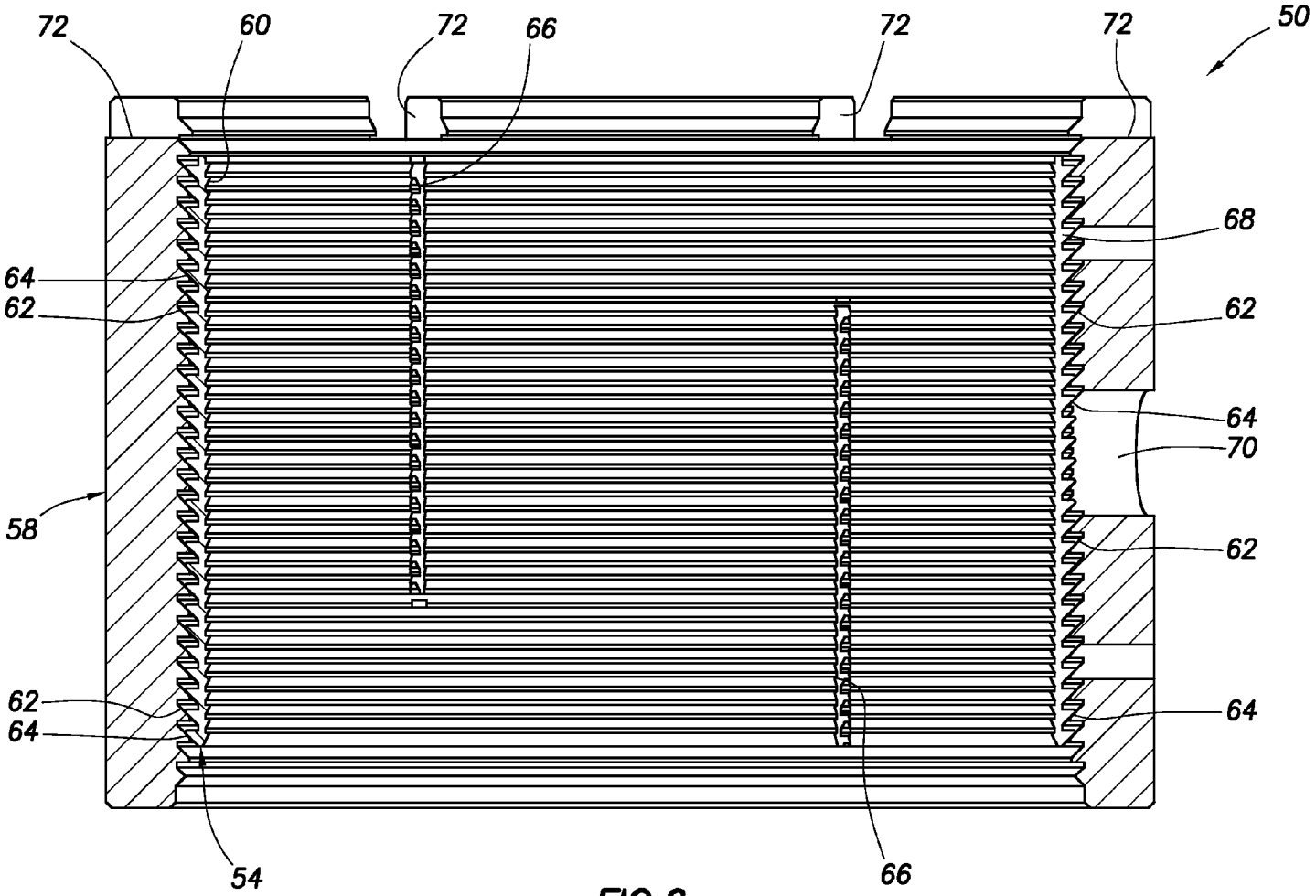
FIG. 6 is a representative cross-sectional view of a mandrel lock device of the packer assembly.

Referring additionally now to FIG. 6, an enlarged scale cross-sectional view of the lock device 50 is representatively illustrated, apart from the remainder of the packer assembly 20. In this view, it may be seen that the lock device 50 includes an inner body lock ring 54 and an outer bias sleeve 58.

The body lock ring 54 is used to grip an outer surface of the mandrel 42, in order to permit only one-way displacement of a structure (such as, the wedge device 32 or the structure 52) relative to the mandrel. For this purpose, the body lock ring 54 in the FIG. 6 example includes an interior surface 60 configured to grippingly engage the outer surface of the mandrel 42.

In this example, the interior surface 60 has teeth (which may be in the form of threads) formed thereon for gripping the outer surface of the mandrel 42. However, in other examples, other ways of gripping the mandrel 42 may be used (e.g., with a coarse texture formed on the interior surface 60, etc.), and so it should be understood that the scope of this disclosure is not limited to any particular way of gripping the mandrel.

The bias sleeve 58 is used to bias the body lock ring 54 radially inward, so that the body lock ring is maintained in gripping engagement with the outer surface of the mandrel 42. For this purpose, multiple inclined surfaces 62 (which may be in the form of threads) are formed in the bias sleeve 58 and engaged with complementarily shaped inclined surfaces 64 formed on the body lock ring 54.

In this example, the inclined surfaces 62, 64 are similar in form to buttress-type threads, so that upward displacement of the bias sleeve 58 relative to the body lock ring 54 compresses the body lock ring radially inward. Such radially inward biasing of the body lock ring 54 causes the interior surface 60 (with teeth, threads, etc., thereon) to increasingly grip the outer surface of the mandrel 42.

In this example, the body lock ring 54 is in the form of a longitudinally extended ring having multiple partial longitudinal slits 66 which enhance radial flexibility of the body lock ring. A full longitudinal slit 68 enables the body lock ring 54 to be radially enlarged via a tool (such as, a snap ring pliers-type tool) inserted via an opening 70 in the bias sleeve 58, for installation of the mandrel lock device 50 on the mandrel 42.

In one example method of constructing the packer assembly 20, the body lock ring 54 is installed in the bias sleeve 58, so that the inclined surfaces 62, 64 are engaged with each other, as depicted in FIG. 6. A tool is inserted through the opening 70, and is used to spread the slit 68 apart, so that the body lock ring 54 is radially enlarged.

The mandrel lock device 50 is then installed on the mandrel 42, and the bias sleeve 58 is secured against rotation relative to the mandrel using slots 72, as described more fully below. The tool is then removed, so that the body lock ring 54 springs back radially inward into gripping engagement with the outer surface of the mandrel.

Note that neither the body lock ring 54 nor the bias sleeve 58 is rotated relative to the mandrel 42 during this installation technique. In this manner, damage that could otherwise be caused to the outer surface of the mandrel 42 by rotation or gripping engagement of the interior surface 60 relative to or with the outer surface of the mandrel is prevented.

Figure 7:
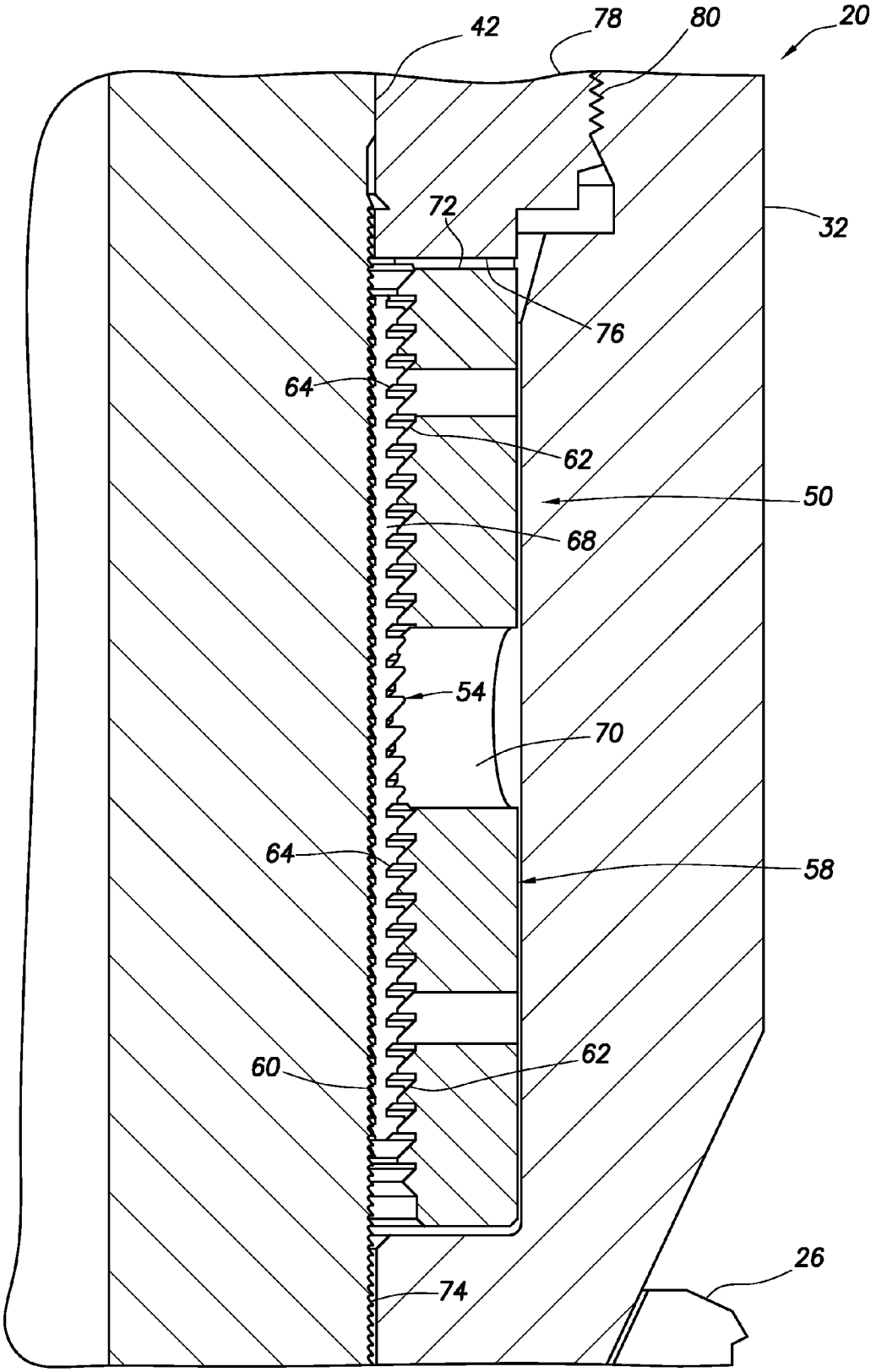
FIG. 7 is a representative cross-sectional view of the mandrel lock device installed in the packer assembly.

Referring additionally now to FIG. 7, a further enlarged scale cross-sectional view of the mandrel locking device 50 as installed in the packer assembly 20 is representatively illustrated. In this view, it may be seen that the interior surface 60 of the body lock ring 54 is grippingly engaged with the outer surface 74 of the mandrel 42, and the slots 72 in the bias sleeve 58 are engaged by tabs 76 formed on a compressive load transfer component 78 of the setting mechanism 28.

In the method of constructing the packer assembly 20, the tabs 76 are engaged with the slots 72 (thereby preventing rotation of the mandrel lock device 50 relative to the component 78 and the mandrel 42), and then the tool used to spread the slit 68 is removed (thereby allowing the body lock ring 54 to compress radially inward into gripping engagement with the mandrel 42). In this example, the outer surface 74 of the mandrel 42 has teeth (which may be in the form of threads) formed thereon for engagement with the interior surface 60 of the body lock ring 54.

The upper wedge device 32 can then be installed onto the mandrel 42, over the mandrel lock device 50, and secured to the component 78 (for example, using threads 80). Note that the wedge device 32 can be rotated relative to the mandrel 42, mandrel lock device 50 and component 78 while it is being secured to the component, whereas the bias sleeve 58 is prevented from rotating by the engagement of the slots 72 and tabs 76.

The gripping device 26 and a remainder of a lower section of the packer assembly 20 can then be assembled onto the mandrel 42. Note that a similar assembly technique can be followed for the structure 52 used to outwardly extend the seal element 24. That is, the mandrel lock device 50 (or a similar lock device) can be installed on the mandrel 42 and secured against rotation relative to the mandrel, and then the structure 52 can be secured (for example, to another component of the setting mechanism 28).

Note that the scope of this disclosure is not limited to any of the particular structures, members, components or devices described above or depicted in the drawings. For example, it is not necessary for a single barrel slip-type gripping device 26 to be used in the packer assembly 20, for the multiple rod pistons 44 to be used, etc. Instead, any type of packer assembly can incorporate the principles of this disclosure.

It may now be fully appreciated that the above disclosure provides significant advancements to the art of constructing and utilizing packer assemblies. In an example described above, a mandrel lock device 50 with a body lock ring 54 that grippingly engages an outer surface 74 of a mandrel 42 can be installed on the mandrel without rotation relative to the mandrel, thereby preventing improper operation of a packer assembly 20 or damage to the outer surface of the mandrel.

The above disclosure provides to the art a packer assembly 20 which, in one example, can include a setting mechanism 28 which displaces a structure (such as, the upper wedge device 32 or the structure 52) relative to a mandrel 42. A mandrel lock device 50 permits one-way displacement of the structure 32 or 52 relative to the mandrel 42. The mandrel lock device 50 includes a body lock ring 54 and a bias sleeve 58 which urges the body lock ring 54 toward gripping engagement with the mandrel 42. The bias sleeve 58 and the structure 32 or 52 are separate elements of the packer assembly 20.

The structure 32 or 52 can be rotatable relative to the bias sleeve 58.

The bias sleeve 58 may be received in the structure 32 or 52.

The bias sleeve 58 can be secured against rotation relative to a compressive load transfer component 78 of the setting mechanism 28. The structure 32 or 52 may be secured to the component 78 with threads 80.

The bias sleeve 58 can include an opening 70 aligned with a longitudinal slit 68 formed through the body lock ring 54. The opening 70 may be covered by the structure 32 or 52.

The structure 32 can comprise a wedge device which outwardly extends a gripping device 26 of the packer assembly 20 in response to displacement of the structure by the setting mechanism 28.

Displacement of the structure 52 by the setting mechanism 28 may outwardly extend a seal element 24 of the packer assembly 20.

A method of constructing a packer assembly 20 is also described above. In one example, the method can comprise: installing a body lock ring 54 on a mandrel 42 of the packer assembly 20; and then outwardly surrounding the body lock ring 54 with a structure (such as, the wedge device 32 or the structure 52) which is displaceable relative to the mandrel 42 by a setting mechanism 28 of the packer assembly 20.

The method can include installing the body lock ring 54 in a bias sleeve 58 prior to the step of installing the body lock ring 54 on the mandrel 42.

The body lock ring 54 may permit displacement of the structure 32 or 52 in one direction relative to the mandrel 42 by the setting mechanism 28, but prevent substantial displacement of the structure 32 or 52 in another direction opposite to the first direction relative to the mandrel 42. The bias sleeve 58 urges the body lock ring 54 into gripping engagement with the mandrel 42 in response to displacement of the structure 32 or 52 in the second direction relative to the mandrel 42.

The step of installing the body lock ring 54 on the mandrel 42 may include securing the bias sleeve 58 against rotation relative to the setting mechanism 28.

The method can include securing the structure 32 or 52 to the setting mechanism 28 after the step of securing the bias sleeve 58.

The step of securing the structure 32 or 52 to the setting mechanism 28 may include rotating the structure 32 or 52 relative to the mandrel 42. The step of rotating the structure 32 or 52 can be performed while rotation of the body lock ring 58 relative to the mandrel 42 is prevented.

A packer assembly 20 described above can include a setting mechanism 28 which sets the packer assembly 20 in a well. The setting mechanism 28 displaces a structure (such as the upper wedge device 32 or the structure 52) relative to a mandrel 42 of the packer assembly 20. A mandrel lock device 50 permits displacement of the structure 32 or 52 in a first direction relative to the mandrel 42 by the setting mechanism 28, but prevents substantial displacement of the structure 32 or 52 in a second direction opposite to the first direction relative to the mandrel 42. The mandrel lock device 50 includes a body lock ring 54 with an interior surface 60 configured to grip the mandrel 42, and a bias sleeve 58 which urges the body lock ring 54 toward gripping engagement with the mandrel 42 in response to displacement of the structure 32 or 52 in the second direction relative to the mandrel 42. The bias sleeve 58 is secured against rotation relative to the mandrel 42 while the structure 32 or 52 is rotatable relative to the mandrel 42.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A packer assembly, comprising:

a setting mechanism which displaces a structure relative to a mandrel; and a mandrel lock device which permits one-way displacement of the structure relative to the mandrel, the mandrel lock device including a body lock ring and a bias sleeve which urges the body lock ring toward gripping engagement with the mandrel, the bias sleeve and the structure being separate elements of the packer assembly, wherein the bias sleeve includes an opening aligned with a longitudinal slit formed through the body lock ring, and wherein the opening is covered by the structure.

2. The packer assembly of claim 1, wherein the structure is rotatable relative to the bias sleeve.

3. The packer assembly of claim 1, wherein the bias sleeve is received in the structure.

4. The packer assembly of claim 1, wherein the bias sleeve is secured against rotation relative to a compressive load transfer component of the setting mechanism, and wherein the structure is secured to the component with threads.

5. The packer assembly of claim 1, wherein the structure comprises a wedge device which outwardly extends a gripping device of the packer assembly in response to displacement of the structure by the setting mechanism.

6. The packer assembly of claim 1, wherein displacement of the structure by the setting mechanism outwardly extends a seal element of the packer assembly.

7. A method of constructing a packer assembly, the method comprising:

installing a body lock ring in a bias sleeve prior to installing the body lock ring on a mandrel of the packer assembly; and then outwardly surrounding the body lock ring with a structure which is displaceable relative to the mandrel by a setting mechanism of the packer assembly.

8. The method of claim 7, wherein the body lock ring permits displacement of the structure in a first direction relative to the mandrel by the setting mechanism, but prevents substantial displacement of the structure in a second direction opposite to the first direction relative to the mandrel, and wherein the bias sleeve urges the body lock ring into gripping engagement with the mandrel in response to displacement of the structure in the second direction relative to the mandrel.

9. The method of claim 7, wherein the installing the body lock ring on the mandrel further comprises securing the bias sleeve against rotation relative to the setting mechanism.

10. The method of claim 9, further comprising securing the structure to the setting mechanism after the securing the bias sleeve.

11. The method of claim 10, wherein the securing the structure to the setting mechanism further comprises rotating the structure relative to the mandrel.

12. The method of claim 11, wherein the rotating the structure is performed while rotation of the body lock ring relative to the mandrel is prevented.

13. The method of claim 7, wherein the structure comprises a wedge device which outwardly extends a gripping device of the packer assembly in response to displacement of the structure in the first direction by the setting mechanism.

14. The method of claim 7, wherein displacement of the structure by the setting mechanism outwardly extends a seal element of the packer assembly.

15. A packer assembly, comprising:

a setting mechanism which sets the packer assembly in a well, wherein the setting mechanism displaces a structure relative to a mandrel of the packer assembly; and a mandrel lock device which permits displacement of the structure in a first direction relative to the mandrel by the setting mechanism, but which prevents substantial displacement of the structure in a second direction opposite to the first direction relative to the mandrel, the mandrel lock device including a body lock ring with an interior surface configured to grip the mandrel, and the mandrel lock device further including a bias sleeve which urges the body lock ring toward gripping engagement with the mandrel in response to displacement of the structure in the second direction relative to the mandrel, and the bias sleeve being secured against rotation relative to the mandrel while the structure is rotatable relative to the mandrel.

16. The packer assembly of claim 15, wherein the structure is rotatable relative to the bias sleeve.

17. The packer assembly of claim 15, wherein the bias sleeve is received in the structure.

18. The packer assembly of claim 15, wherein the bias sleeve is secured against rotation relative to a compressive load transfer component of the setting mechanism, and wherein the structure is secured to the component with threads.

19. The packer assembly of claim 15, wherein the bias sleeve includes an opening aligned with a longitudinal slit formed through the body lock ring, and wherein the opening is covered by the structure.

20. The packer assembly of claim 15, wherein the structure comprises a wedge device which outwardly extends a gripping device of the packer assembly in response to displacement of the structure in the first direction by the setting mechanism.

21. The packer assembly of claim 15, wherein displacement of the structure by the setting mechanism outwardly extends a seal element of the packer assembly.

* * * * *